United States Patent [19]

McMillen

[11] 4,150,271

[45] Apr. 17, 1979

[54] CIRCUIT INTERRUPTER WITH TIME DELAY MANUAL SPRING CHARGING HANDLE

[75] Inventor: James W. McMillen, Wilkins Township, Allegheny County, Pa.

[73] Assignee: Westinghouse Electric Corp., Pittsburgh, Pa.

[21] Appl. No.: 877,777

[22] Filed: Feb. 14, 1978

[51] Int. Cl.[2] ..... H01H 3/02; H01H 3/20; H01H 7/00

[52] U.S. Cl. ..... 200/153 H; 200/332; 200/334; 200/335

[58] Field of Search ..... 200/153 G, 153 H, 329, 200/330, 331, 332, 334, 335, 338; 74/547, 519

[56] References Cited

U.S. PATENT DOCUMENTS 3,037,098 5/1962 Fourcade ..... 200/329

FOREIGN PATENT DOCUMENTS 1279478 11/1961 France ..... 200/330
1403351 8/1975 United Kingdom ..... 200/335

*Primary Examiner*—Richard E. Aegerter
*Assistant Examiner*—John W. Shepperd
*Attorney, Agent, or Firm*—M. J. Moran

[57] ABSTRACT

A load type circuit switch of the kind requiring a minimum time delay between the closing thereof and opening thereof is taught. The minimum time delay is utilized to allow a separate circuit clearing apparatus to completely interrupt overload current in the event the switch contacts are closed upon an overload. The time delay is provided by a removable manual spring charging handle which is collapsible or non-operable in one direction of movement. The handle is rectangularly shaped and is inserted in a rectangular opening in a movable hub of a spring charging mechanism. The handle is insertable into the rectangular opening in an orientation which is appropriate to allow charging of the spring for the closing operation. After the closing operation, attempted movement of the handle in the opposite direction will cause collapse thereof thus preventing recharging of the spring for a subsequent circuit breaker contact opening operation. In order to recharge the spring, the handle must be physically removed from the keyed opening rotated 180 degrees then reinserted so that movement in the other direction may take place. The minimum time delay is related to the time interval it takes to remove the handle, rotate it, and then reinsert it.

7 Claims, 11 Drawing Figures

CIRCUIT INTERRUPTER WITH TIME DELAY MANUAL SPRING CHARGING HANDLE

BACKGROUND OF THE INVENTION

The subject matter of this invention is related to circuit interrupter apparatus in general and to mechanical time delay handles for circuit breaker apparatus in particular.

DESCRIPTION OF THE PRIOR ART

Load type circuit switching apparatus is well known in the prior art and is described for example in U.S. Pat. No. 3,652,815 issued Mar. 28, 1972 to Davies. The latter patent is assigned to the assignee of the present invention. The circuit switch taught therein comprises a set of contacts which may be opened or closed by manually charging a spring with a removable lever handle and then discharging the spring to either open the contacts or close the contacts. The spring arrangement is such that movement of the handle in one vertical direction from top to bottom, for example, causes an opening of the circuit switch, whereas movement of the vertical handle in the other direction, from bottom to top, causes a closing of the circuit switch. It is known that it is undesirable to close the contacts of a load type switch on an overload circuit and then immediately reopen the switch without allowing sufficient time for serially connected circuit protective devices to interrupt an overload should one exist. Generally, overloads of a catastrophic magnitude will be interrupted in a relatively short period of time which is typically less than three to eight seconds. However, the arrangement of certain prior art switches is such as to allow a closing and a subsequent opening of the contacts in a time period which is shorter then the three to eight seconds. This means it is possible in some of the prior art to open the contacts almost immediately after closure thereof on a catastrophic fault. Such an opening is extremely dangerous as it may cause physical harm to the operator of the switch mechanism or may cause damage to the circuit switch apparatus or both. Consequently, it is desirous to provide a means for delaying the reopening of circuit switch contacts for a minimum required period of time after closure thereof. In the past other prior art devices overcame this problem by providing spring actuating push buttons which operate in conjunction with the manual spring charging drive. For example, a spring charging rod is manually moved in one direction and then a close push button is actuated to cause the spring to be released to close the contacts of the circuit switch. Then the rod or lever arm may be moved in the other direction to once again recharge the spring for a subsequent circuit breaker opening operation by actuating a separate opening push button. To provide the appropriate time delay, a shutter mechanism is provided which covers either one of the push buttons or the other. A time consuming mechanical operation is required for changing the disposition of the shutter to allow the operator to go from a circuit closing to a circuit opening operation or vice versa. This therefore provides the requisite time delay. In the prior art circuits a handle type spring charging mechanism did not necessarily have to be used for operation; an electrical motor could be used in some instances. The delay feature was found in the actuation step where actuation of the push buttons was delayed. In the prior art of the aforementioned U.S. Pat. No. 3,652,815 no push buttons are provided, rather the spring has a two stable discharged positions. One which corresponds to the contacts being opened and the other which corresponds to the contacts being closed. Consequently, as the handle rod or lever is rotated in one direction, the spring is moved from one stable position to a toggle position after which the spring discharges into a lever which opens or closes the contacts as desired. When the handle is moved in the other direction the spring is recharged to the toggle position whereupon it releases to move the lever mechanism to close the contacts. Of course, it can be seen in a situation such as this that the opening and closing operations are not separated from the spring charging operation as was the case with other prior art mechanisms. However, the need for time delay still exists. Consequently, it would be desirable if a single stroke spring charging and circuit contact actuation device could be utilized as is taught in the aforementioned U.S. Pat. No. 3,652,815, but where time delay could somehow be provided to prevent a catastrophic premature opening of the circuit breaker contacts after a recent closure on a overload.

SUMMARY OF THE INVENTION

In accordance with the invention, an electrical switch of the type in which a time delay is required between the making and breaking of the same set of contacts is taught. There is provided a movable contact actuating means which is interlinked with the contacts for making the contacts in response to movement of a contact actuating means in a first direction and for breaking the contacts in response to movement of the same contact actuating means in a second direction. The contact actuating means has a keyed opening therein for insertion therein of handle means for moving the movable actuating means. A collapsible handle means is provided for manual insertion into the keyed opening in a first keyed insertion relationship for moving the contact actuating means in the first direction to make the contacts. The handle means however collapses when attempts are made to move it in the second direction while it remains in the first keyed insertion relationship. Movement in the second direction can be accomplished by physically changing the keyed relationship of the collapsible handle means to a second keyed relationship. The time required to manually change the insertion relationships is always larger by design than the minimum time required to clear a fault on the circuit by separate serially connected protective devices.

BRIEF DESCRIPTION OF THE DRAWINGS

For a better understanding of the invention, reference may be had to the preferred embodiments thereof shown in the accompanying figures in which.

DESCRIPTION OF THE PREFERRED EMBODIMENT

Figure 1:
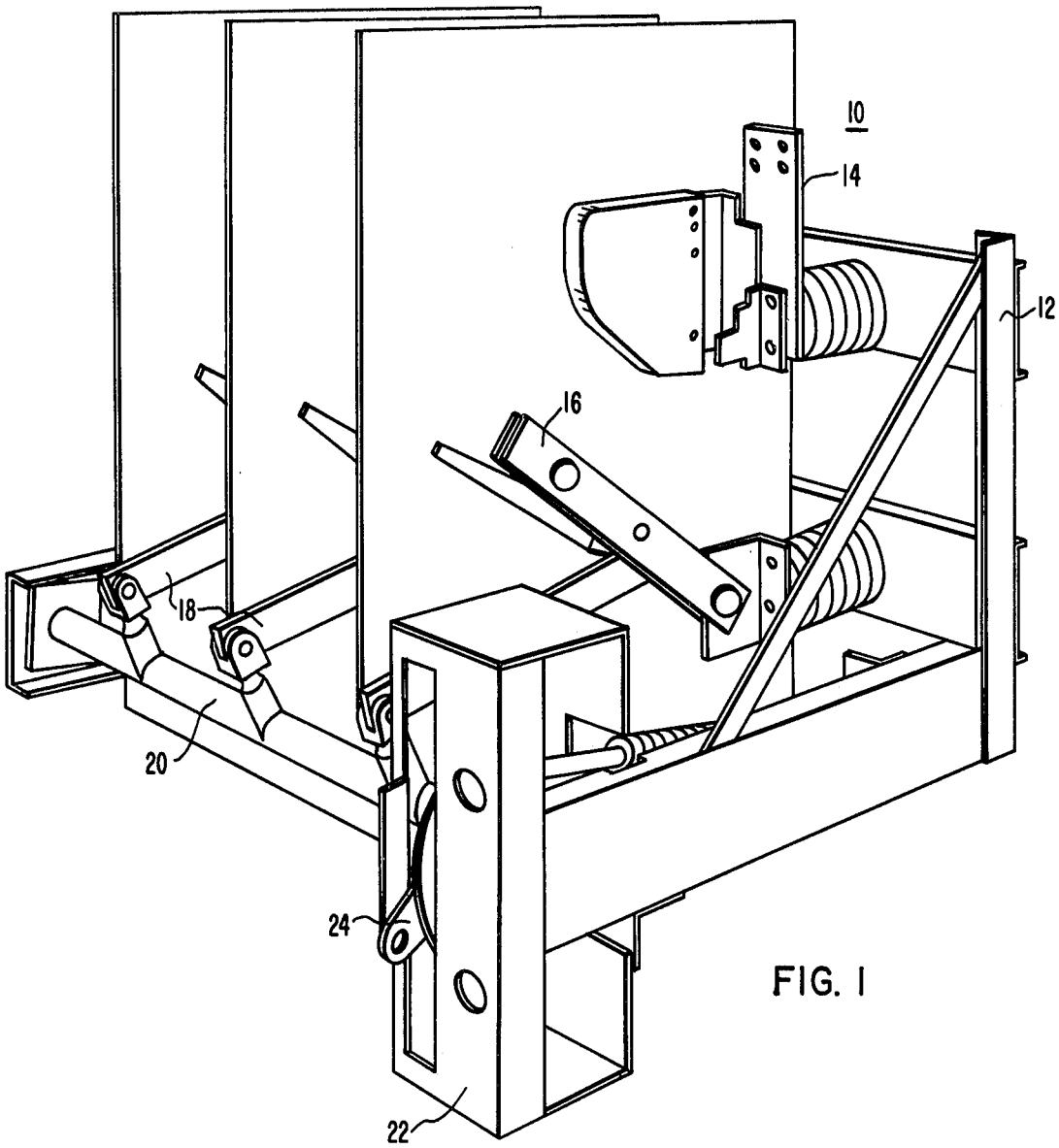
FIG. 1 shows an orthogonal view of a three-phase load switch of the type having a toggle operating single stroke contact opening and closing arrangement.

Referring now to the drawings and FIG. 1 in particular, a load interrupter switch which may be of the type which is available for 600 and 1200 amperes continuous current rating for all voltage classes ranging from 2.4 kv through 13.8 kv with interrupting ratings of 600 and 1200 amperes is taught. Furthermore the switch shown in FIG. 1 may have momentary ratings of 40,000; 61,000; and 80,000 amperes with fault closing ratings of 20,000; 40,000; and 61,000 amperes. In addition, the switch may be of the type which is available for use in a three pole frame mounted construction for mounting in enclosures and assemblies. Furthermore the switch is of the type which may be utilized in conjunction with separate fuses. Switches of the type shown in FIG. 1 may be used to provide safe, non-automatic switching for sectionalizing primary feeders and isolating transformer banks, capacitors, voltage regulators and similar apparatus. Furthermore, the switch may be used in series with expulsion or current limiting fuses that provide excellent fault protection. Also the switch shown in FIG. 1 may be of the type used in indoor operations. The switch 10 of FIG. 1 may be a three-phase switch of the type having a frame 12 upon which is disposed a stationary contact 14 and a movable contact 16. The movable contact 16 may be moved into and out of electrically conducting disposition with the stationary contact 14 by way of an operating rod 18 which is pivotally attached to a shaft 20. The operation of the shaft 20 is controlled from an operating mechanism housing 22 having a single stroke handle operated opening and closing mechanism 24 contained therein.

Figure 2:
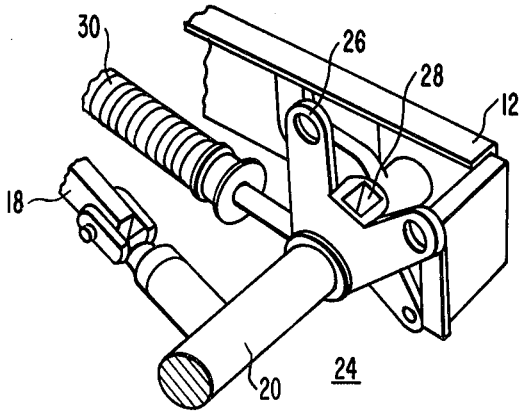
FIG. 2 shows a partial orthogonal view of a portion of the apparatus of FIG. 1.
Figure 3:
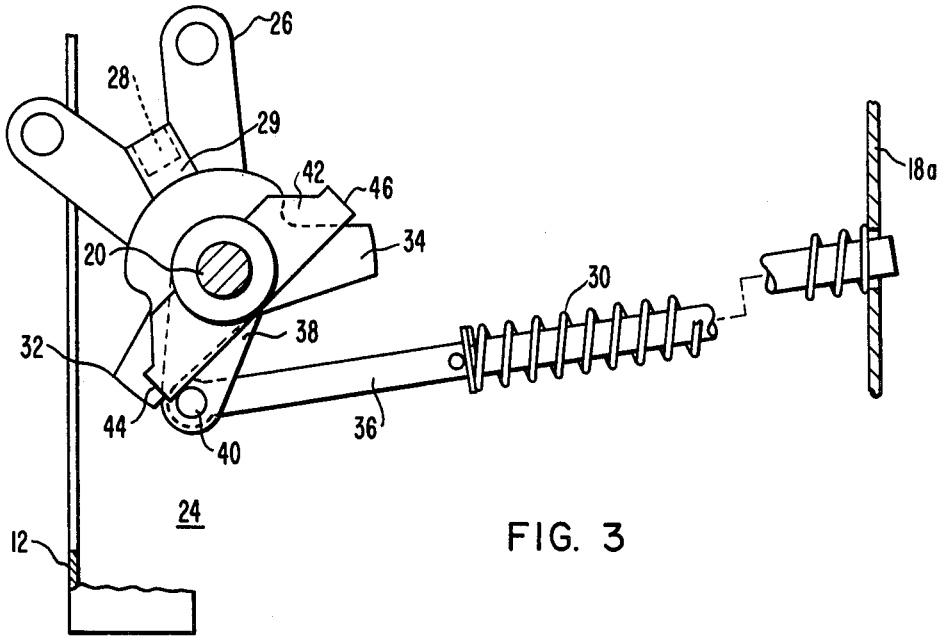
FIG. 3 shows a side elevation partially in section and partially broken away of the spring charging toggle mechanism shown in FIG. 2.
Figure 6:
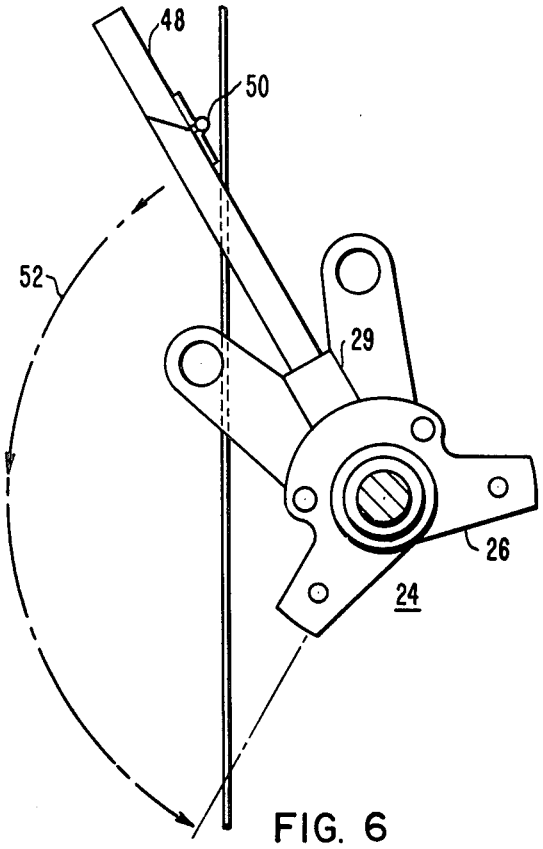
FIGS. 6 and 7 show a side view partially broken away of the disposition of the handle spring charging means for a circuit breaker opening operation.

Referring now to FIGS. 2 and 3 the operation of the single stroke mechanism 24 of FIG. 1 is described. Disposed upon the shaft 20 but free to rotate thereabout without movement of the shaft 20 is a handle casting or hub 26 which has a keyed opening 28 in a protrusion 29 thereof. The handle casting 26 may be utilized to move a spring 30 of a spring operated toggle mechanism which has a connecting rod 36 which is pivotally connected to a freely rotating support member 38 at a pivot pin 40. The spring toggle mechanism as described does not move shaft 20 by way of linkage 38; rather shaft 20 is rigidly attached to a set of dogs 44 and 46, the movement of which causes corresponding movement of the shaft 20. Said in another way if the dog 46 is rotated in the counterclockwise direction as viewed with respect to FIG. 3 for example, the shaft 20 will correspondingly rotate, thus causing the connecting rods 18 as shown in FIG. 1 to move outwardly thus separating the movable contact 16 from the fixed contact 14. In a like manner if the dog 44 is forced to move in a clockwise direction, the shaft 20 which is rigidly attached thereto will be rotated in a clockwise rotation to cause the connecting rods 18 to force the movable contact 16 into a disposition of electrical contact with the stationary contact 14. The pin 40 of the connecting rod 36 protrudes sufficiently far from the support member 38 so as to be in a disposition to contact the dog 44 or dog 46 during certain portions of the operating cycle of the toggle mechanism which is associated with the connecting rod 36 and the spring 30. As is shown in FIG. 3 the spring 30 and the connecting rod 36 are in a first of two stable spring relaxed dispositions. This disposition corresponds to the disposition in which the contact 16 and the contact 14 of FIG. 1 are made or in a closed state. From this disposition the handle casting 26 may be rotated counterclockwise about the axis 20 so that a dog 32 thereon may pick up the pin 40 thus forcing the connecting rod 36 to the right, as viewed in FIG. 3, thus compressing the spring 30. Continued rotation of the handle casting mechanism 26 will cause the connecting rod to pass over toggle thus freeing it from abutment with the dog 32 and allowing it to be forcefully moved to the left by the discharge of the spring 30 above the horizontal axis of the shaft 20 to thus make abutting contact with the dog 46 to forcefully move the shaft 20 to open the circuit breaker contacts 14 and 16. Movement of the casting 26 through approximately 120 degrees of rotation such as is shown in FIG. 6 causes the previously mentioned operation. When the circuit breaker contacts are opened the casting 26 may be moved from a position similar to that shown in FIG. 8 upwardly in a clockwise direction thus forcing the connecting rod 36 and the spring 30 to a disposition of compression by the dog 34 until the overtoggle position is reached in which case the spring 30 discharges with great force causing the pin 40 to make forceful contact with the dog 44 thus closing separable main contacts 16 and 14.

Figure 4:
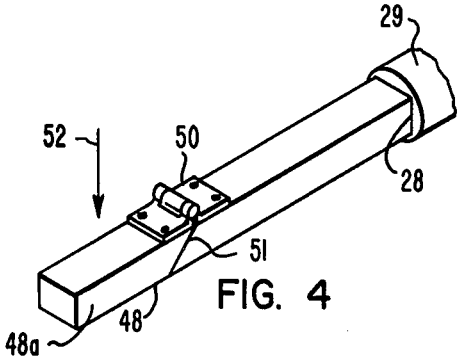
FIG. 4 shows a collapsible handle for insertion in the single stroke apparatus of FIGS. 1, 2 and 3.
Figure 5:
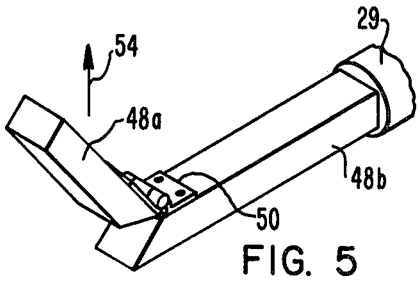
FIG. 5 shows the handle of FIG. 4 in a collapsed disposition.

Referring to FIG. 4 an operating handle 48 for the casting 26 of the mechanism 24 of FIGS. 2 and 3 is shown. The handle 48 is shown as having a rectangular cross-section and as being inserted in a rectangularly keyed hole or opening 28 in the protruding portion 29 of the casting 26. The handle 48 is divided or broken into two parts which are joined at the region 51 by way of a hinge 50. Consequently, any time the handle is moved in the direction 52 for example, as shown in FIG. 4, forceful rotation will be provided to the portion 29 thus causing rotation of the casting 26 as described previously and as is shown in FIG. 6, for example. However, attempted movement of the handle in the direction 54 such as is shown in FIG. 5 will merely cause collapse of the handle by movement of the hinge 50 and opening of the region 51, rather than movement of the protruding portion 29. Consequently, it can be seen by comparing FIGS. 4 and 5 that movement of the handle in one direction and consequential movement of the casting 26 is possible, but movement in the other direction is prevented as long as the hand of the operator is maintained on portion 48*a* of the shaft 48 rather than on portion 48*b*. By making the portion 48*b* relatively short compared with the portion 48*a*, the likelihood of the operator being able to grasp it is significantly reduced. Portion 48*b* can be made so short that it is unreachable within the protective covering 22 for the mechanism 24 as shown in FIG. 1.

Figure 7:
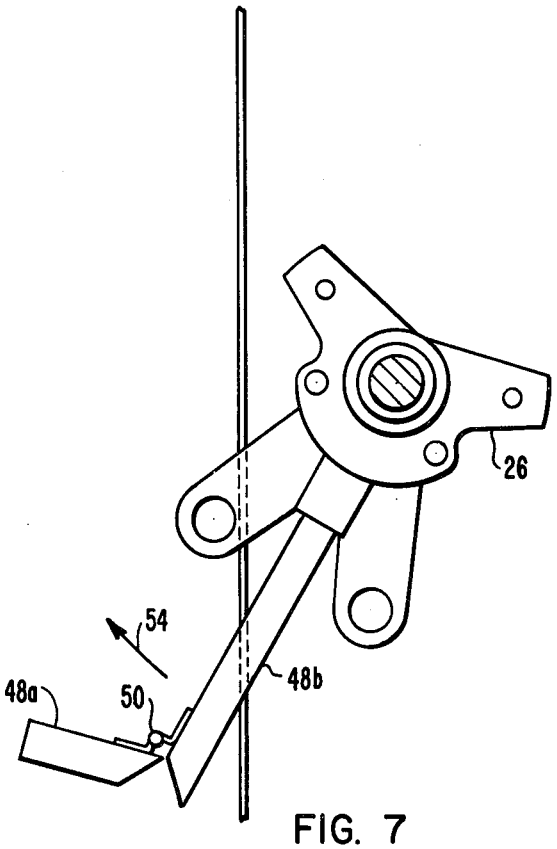

Referring to FIGS. 6 and 7, an opening operation with the handle 48 in a proper disposition for opening in the direction 52 is shown. A subsequent attempt to move the shaft 48 in the direction 54 will merely collapse the shaft 48 at the hinge 50 without causing clockwise rotation of the casting 26. This is best depicted in FIG. 7.

Figure 9:
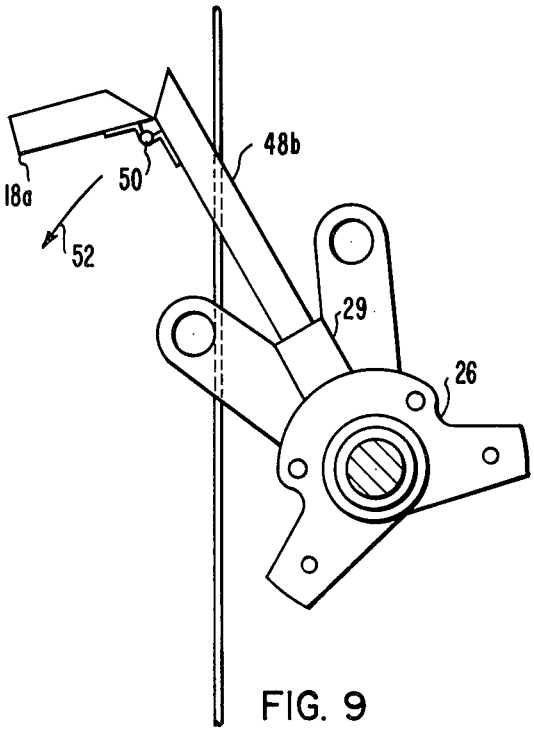
FIGS. 8 and 9 show an orientation similar to that shown in FIGS. 6 and 7 but for a circuit switch closing operation.
Figure 8:
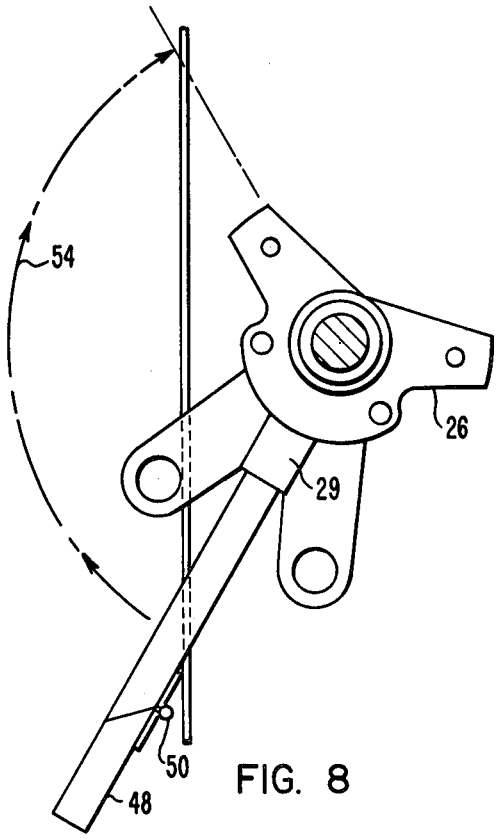

Referring now to FIGS. 8 and 9, a disposition for closing the circuit breaker apparatus by moving the casting 26 in an upward direction is shown. In this case the handle 48 is removed from the keyed opening 28 in the protrusion 29 and physically reversed or rotated about its longitudinal axis by 180 degrees and then reinserted in the opening 28 so that movement in the direction 54 is possible as is shown in FIG. 8. Movement in the direction 52 such as is shown in FIG. 9 will merely result in a collapsing of the handle 48 about the hinge pin of the hinge 50. Consequently, it can be seen that in order to close the circuit switch apparatus and then to subsequently open it again, the physical removal of the handle 48 from the opening 28 in the protrusion 29, the rotation of the handle 48 about its axis and the reinsertion into the opening 28 is required. It has been discovered that the amount of time taken to physically remove the handle 48 and reinsert it can be made shorter than the minimum current clearing time of peripheral circuit clearing protective apparatus (not shown) which may be connected in series circuit relationship with the terminals of the switch 10. Consequently, the mere provision of a collapsible handle 48 provides a minimum time delay feature for the switch apparatus 10, which time delay prevents a relatively quick closing and subsequent reopening of the circuit switch 10. Relatively quick reopening of the circuit breaker of switch 10 once it has been closed on a fault that has not been cleared may lead to catastrophic results to personnel or property.

Figure 10:
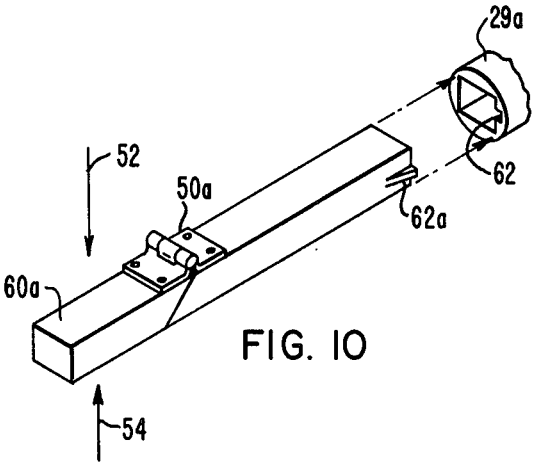
FIGS. 10 and 11 show complementary plural operating rods for use in a single keyed spring charging and circuit breaker operating apparatus.
Figure 11:
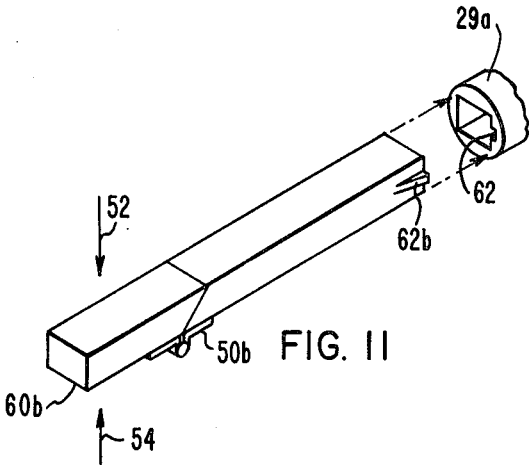

Referring now to FIGS. 10 and 11, complementary keyed switch handles **60*a* and 60*b* are shown. Handle 60*a* has a hinged arrangement 50*a* which allows it to be moved downward when inserted into protrusion 29*a* in proper orientation for the key 62*a* and the keyway 62. On the other hand FIG. 11 shows a hinged handle 60*b* which may be inserted into the same key way 62 in the same protrusion 29*a* by way of a differently oriented key 62*b* on the handle 60*b*. The hinging arrangement 50*b* is such in this case that movement of the handle 60*b* in the direction 54 will cause rigid operation thereof but movement of the handle in the direction 52 will cause collapse thereof. Consequently, the complementary handles of FIGS. 10 and 11 may be used one at a time to open and close the circuit apparatus of FIG. 1 for example if the proper key arrangement such as shown at 62 has been provided in the protrusion 29*a*. This means that the one handle 60*a* or 60*b* must be removed and be replaced by the other 60*b* or 60*a*** respectively for subsequent circuit interrupter opening and closing operations. The amount of time necessary to remove one handle and replace it with another is such that serially connected circuit protective apparatus will operate to clear a fault before a subsequent opening operation can be completed.

It is to be understood with respect to the embodiments of this invention that the keying arrangements shown most clearly in FIGS. 2, 4, 5, 10 and 11 for example are not limiting provided a keying arrangement of some kind is utilized. The rectangular shape of the cross-section of the apparatus of FIGS. 4 and 5 is merely illustrative of a key arrangement where one handle may be rotated 180 degrees and used for both circuit breaker closing and opening operations. In a like manner, the complementary keys **62*a* and 62*b* used in conjunction with the keyway 62** is an example of another keying arrangement. Any keying arrangement which allows for movement of a handle in one direction and then subsequent collapse of the handle when movement is attempted in the other direction before the keying arrangement is changed will suffice to provide the desired operation.

The apparatus taught with respect to the embodiments of this invention has many advantages. One of the advantages lies in the fact that it offers safety for a circuit interrupting operation without the necessity of complex circuit breaker apparatus. The mere provision of handle with an appropriate keyed closing mechanism provides sufficient time delay to significantly decrease the likelihood of property damage or physical injury in the closing and quick reopening of circuit switch apparatus. Another advantage lies in the fact that the time delay feature is provided mainly by the handle itself. Consequently, a failure in the mode of time delay operating apparatus usually means a failure of the handle. Thus, replacement is simple when compared with replacement of an onboard mechanism as is the case with the prior art. Another advantage lies in the simplicity of the apparatus used for the protective operation. Another advantage lies in the fact that it is relatively inexpensive to utilize and to construct. Still a further advantage lies in the fact that it is relatively foolproof.

What I claim as my invention is:

1. An electrical switch of the type in which a minimum time delay is required between the making and breaking of the same set of contacts, comprising:

(a) movable contact actuating means interlinked with said set of contacts for making said contacts in response to movement of said contact actuating means in a first direction and for breaking said contacts in response to movement of said contact actuating means in a second direction, said movable contact actuating means having a keyed opening therein for insertion therein of handle means for so moving said movable contact actuating means;

(b) first collapsible handle means for insertion in said keyed opening in keyed relationship therewith for manually moving said contact actuating means in said first direction to make said contacts but for collapsing when manually moved in said second direction for thus preventing manual breaking of said contacts while said first collapsible handle means remains in said keyed insertion relationship with said contact actuating means; and (c) second collapsible handle means for manual insertion in said keyed opening in keyed relationship therewith for manually moving said contact actuating means in said second direction to break said contacts but for collapsing when manual movement is attempted in said first direction for thus preventing manual making of said contacts while said first collapsible handle means remains in said keyed insertion relationship with said contact actuating means, the time required to manually interchange said first and second handle means being equal to or greater than said minimum required time delay.

2. An electrical switch of the type in which a time delay is required between the making and breaking of the same set of contacts, comprising:

(a) movable contact actuating means interlinked with said set of contacts for making said contacts in response to movement of said contact actuating means in a first direction and for breaking said contacts in response to movement of said contact actuating means in a second direction, said movable contact actuating means having a keyed opening therein for insertion therein of handle means for so moving said movable contact actuating means;

(b) collapsible handle means for manual insertion in said keyed opening a first keyed insertion relationship therewith for moving said contact actuating means in said first direction to make said contacts but for collapsing when manual movement is attempted in said second direction while in said first keyed insertion relationship for thus preventing manual breaking of said contacts, said collapsible handle means also being for manual insertions in said keyed opening in a second keyed insertion relationship therewith for moving said contact actuating means in said second direction to break said contacts but for collapsing when manual movement is attempted in said first direction while in said second keyed insertion relationship for thus preventing manual making of said contacts, the time required to manually change said handle means from said first keyed insertion relationship to said second keyed insertion relationship being equal to or greater than said minimum required time delay.

3. The combination as claimed in claim 2, wherein said keyed opening is rectangular in cross-section, said handle means being correspondingly rectangular at the insertable portions thereof, said handle means thus fitting into said rectangular opening in any of two dispositions, one of which corresponds to said first keyed insertion relationship and the other of which corresponds to said second keyed insertion relationship.

4. The combination as claimed in claim 2 wherein said first and said second keyed insertion relationship are 180 mechanical degrees displaced one from the other.

5. The combination as claimed in claim 2 wherein said handle means is collapsibly hinged.

6. The combination as claimed in claim 2 wherein said first direction is 180 mechanical degrees displaced from said second direction.

7. The combination as claimed in claim 2 wherein said minimum time delay is measured from the time said contacts are made.

* * * * *